US006120252A

United States Patent [19]

Reponen et al.

[11] Patent Number: 6,120,252

[45] **Date of Patent: *Sep. 19, 2000**

[54] GAS SEPARATION CONTROL IN A CENTRIFUGAL PUMP/VACUUM PUMP

[75] Inventors: Voitto Reponen, Karhula; Reijo Vesala, Kotka; Vesa Vikman, Kymi, all of Finland

[73] Assignee: Ahlstrom Machinery Corporation, Espoo, Finland

[ * ] Notice: This patent is subject to a terminal disclaimer.

[21] Appl. No.: 09/163,387

[22] Filed: Sep. 30, 1998

Related U.S. Application Data

[63] Continuation of application No. 08/784,074, Jan. 17, 1997, Pat. No. 5,842,833.

[60] Provisional application No. 60/009,281, Dec. 27, 1995.

[51] Int. Cl.[7] ..... F04B 23/14; F04C 19/00

[52] U.S. Cl. ..... 417/53; 417/202; 417/69; 415/143; 415/169.1

[58] Field of Search ..... 417/202, 201, 417/53, 69, 85; 415/143, 169.1

[56] References Cited

U.S. PATENT DOCUMENTS

| | | |
|---|---|---|
| 3,050,008 | 8/1962 | Pacey et al. . |
| 4,776,758 | 10/1988 | Gullichsen . |
| 4,921,400 | 5/1990 | Niskanen . |
| 4,981,413 | 1/1991 | Elonen et al. . |
| 5,078,573 | 1/1992 | Peroaho et al. . |
| 5,114,310 | 5/1992 | Haavik et al. . |
| 5,116,198 | 5/1992 | Vesala et al. . |
| 5,151,010 | 9/1992 | Vesala et al. . |
| 5,152,663 | 10/1992 | Peroaho et al. . |
| 5,366,347 | 11/1994 | Hoglund . |
| 5,842,833 | 12/1998 | Reponen et al. . |

FOREIGN PATENT DOCUMENTS

| | | |
|---|---|---|
| 807607 | 1/1959 | United Kingdom . |

*Primary Examiner*—Charles G. Freay
*Attorney, Agent, or Firm*—Nixon & Vanderhye P.C.

[57] ABSTRACT

A centrifugal and vacuum pump combination in which the impeller of a centrifugal pump is disposed on the same shaft as a rotor of the vacuum pump, with a gas outlet extending between the centrifugal and vacuum pumps, is operated by positively controlling the flow of gas passing through the gas outlet duct, for example by changing the effective cross-sectional flow area of the outlet duct. The fluent material handled by the pump is preferably a cellulose fiber slurry having a solids consistency of between about 6–15%. The control can be effected automatically in response to solids consistency, inlet pressure, and/or gas content of the slurry being pump. The vacuum pump housing includes an eccentric inner wall, and operation of the pump may be primarily controlled by moving the vacuum pump housing.

18 Claims, 5 Drawing Sheets

GAS SEPARATION CONTROL IN A CENTRIFUGAL PUMP/VACUUM PUMP

This application is a continuation of U.S. application Ser. No. 08/784,074, now U.S. Pat. No. 5,842,833, filed Jan. 17, 1997. This application claims benefit of provisional appln 60/009,281 filed Dec. 27, 1995.

BACKGROUND AND SUMMARY OF THE INVENTION

The present invention relates to a method of controlling the function of a gas-separating centrifugal pump and vacuum pump combination, and a gas-separating centrifugal pump. The apparatus according to the invention is particularly well suited for use as a fluidizing centrifugal pump for pumping pulp of medium consistency (e.g. about 6–15%), but the method and the centrifugal pump utilizing it can also be used in other applications in which the liquid to be pumped contains gas and solid matter.

Earlier known pumps which are used for the above purpose are described, inter alia, in U.S. Pat. Nos. 4,776,758, 4,981,413, 5,078,573, 5,114,310, 5,116,198, 5,151,010, 5,152,663 and 5,366,347. All of the above-mentioned patents deal primarily with pumps for the wood processing industry, which separate gas from pulp suspensions of medium consistency and which are characterized in that, in addition to the conventional impeller, a vacuum pump, preferably a water ring pump, is mounted on the pump shaft in a chamber behind the impeller. Gas outlet openings, through which gas accumulating in front of the impeller of the centrifugal pump can flow to the volume behind the impeller, are disposed in the back plate of the pump impeller, near the impeller shaft. This volume is, in most cases, connected to the suction opening of the vacuum pump through a gas outlet duct at least partly surrounding the pump shaft. When the vacuum pump creates a pressure difference between the volume in front of the impeller and its own pumping chamber, the gas flows through the openings in the impeller and the gas outlet duct at least partly surrounding the shaft to the chamber of the vacuum pump. Because of the eccentricity of its chamber, the vacuum pump creates, in a manner known per se, suction which draws gas into its chamber, and a pressure difference between the atmosphere and its chamber on its outlet side so that the gas is discharged from the chamber of the pump. Usually the separated gas is discharged from the vacuum pump directly to the atmosphere.

Certain special requirements are applied to the centrifugal pump and vacuum pump combinations used for pumping pulp suspensions of the wood processing industry, which have been extensively dealt with in the above-mentioned patents and can therefore here be dealt with relatively briefly.

Firstly, since the material to be pumped contains solid matter, i.e. cellulose fibers, provisions have to made in the construction of the centrifugal pump and the vacuum pump connected to it for the possibility that fibers get into the gas outlet system. For that reason, the back side of the back plate is, for example, provided with back blades, in order to separate fibers from the material which has found its way to the volume behind the impeller. As fibers can also get into the vacuum pump, flushing means are provided both on the suction side and the outlet side of the pump in order to prevent clogging of the ducts by fibers.

Secondly, the conditions can vary considerably when pumping fiber suspensions. The consistency of the pulp, for instance, can vary by several percentage points and the inlet pressure of the pulp by several bars. Since gas removal in front of the impeller, in order to function reliably, requires a certain pressure difference, the inlet pressure must be taken into consideration such as by providing control of the suction of the vacuum pump. This is usually accomplished by providing an auxiliary air duct connected to the suction duct and through which extra air can flow to the vacuum pump when enough gas is not separated in front of the impeller. A valve which opens at a given pressure, e.g. 0.4 bar gauge, is usually connected to the auxiliary air duct.

Thirdly, when pumping fiber suspensions the separated gas does not in most cases consist of pure air, but may often contain various malodorous or even to some degree poisonous or corrosive gases, which should not be discharged directly to the atmosphere. Fibers also get into the outlet of the vacuum pump to some extent, and it should be possible to recover them, so that the outlet pipe of the vacuum pump should not, for that reason also, be connected directly to atmosphere or a drain.

Attempts have been made to fulfil the first two of the above mentioned basic requirements, such as in U.S. Pat. No. 5,366,347, which is based on the idea that a fluidizing centrifugal pump pumping pulp of medium consistency has to be able to operate under three different operating conditions.

In the first case, where the inlet pressure is low, below the atmospheric pressure, a great amount of gas is separated in front of the impeller, so that the capacity of the vacuum pump must be high and the pump has to be able to remove all the gas separated.

In the second case, where the inlet pressure is medium, only slightly above the atmospheric pressure, gas is separated in front of the impeller to some degree, and it must be possible to remove it through the vacuum pump without entraining fibers.

In the third case, where the inlet pressure is high, for instance above 2 bar gauge, no gas is separated and the vacuum pump has nothing to remove.

The '347 patent suggests that the capacity of the vacuum pump should be controlled by moving the housing of the vacuum pump in relation to the rotor of the vacuum pump. The idea is that the vacuum pump in the first operating condition sucks gas from the vacuum space in front of the impeller and is capable of transporting it to a higher, i.e. atmospheric pressure. The pump functions in this case as it is originally meant to function.

In the second operating condition where the gas pressure of the separated gas is above the atmospheric pressure, the housing of the vacuum pump is moved in relation to the rotor into a position in which the vacuum pump creates a pressure difference in opposite direction to that of the first case. In other words, assuming that the inlet pressure of the pulp causes an absolute pressure of 1.5 bar in front of the impeller, the pressure difference in relation to the atmosphere is 0.5 bar. As the pressure difference is relatively great, a counter pressure of for instance 0.3 bar overpressure is produced by means of the vacuum pump, so that the pressure in front of the impeller first has to surpass the counter pressure of the vacuum pump. The gas will in other words flow out to the atmosphere at a pressure difference of only 0.2 bar.

For the third operating condition, the '347 patent suggests that the eccentric housing of the vacuum pump be moved so as to be concentric with the shaft and the rotor of the vacuum pump. That is the pump does not generate any pressure difference in either direction. Presumably, it is assumed that since no gas is separated in front of the impeller, no fibers are able to pass into the gas outlet, in spite of the great pressure difference. However this misses a significant point: when a considerable overpressure exists on the suction side of the centrifugal pump, it tends to cause fluent material to burst out from the pump through all available passages. If the vacuum pump, as described in the '347 patent, is running "idle", i.e. the housing of the vacuum pump is concentric with the rotor and no valve is disposed on the outlet side of the vacuum pump, the absence of which is stated to be an advantage, the pulp suspension (under overpressure) will obviously flow directly through the vacuum pump along the gas outlet channels.

The above mentioned problem could be solved in the pump according to the '347 patent in at least two ways: by arranging a valve on the outlet side of the vacuum pump so that the valve would be closed or throttled when the pump is running "idle", and consequently the whole gas outlet pipe system would be at least partly closed; or by improving the capability of the vacuum pump to produce counter pressure so that the maximal counter pressure generated by the pump would correspond to the highest possible overpressure on the suction side of the centrifugal pump. It has thus on one hand been suggested in the '347 patent that in case of a slight overpressure on the suction side of the centrifugal pump, the eccentricity of the housing of the vacuum pump should be changed so that the vacuum pump produces a counter pressure great enough to "dampen" the overpressure. On the other hand, it is also suggested that the eccentricity of the housing of the vacuum pump be further decreased to zero when the overpressure on the suction side of the centrifugal pump increases. However the latter suggestion results, in practice, in a pump that leaks excessively. The matter can however easily be corrected by increasing the eccentricity of the housing of the vacuum pump as well, so that the counter pressure produced by the vacuum pump increases when the overpressure of the centrifugal pump increases. In other words, by keeping the counter pressure produced by the vacuum pump the same as the inlet pressure, there will be no flow in either direction in the vacuum pump. The effect of the inlet pressure can naturally be reduced also by providing a throttling valve on the outlet side of the vacuum pump, contrary to the teaching of the '347 patent, so that the inlet pressure can be "dampened" by means of the throttling valve as well as by changing the eccentricity of the housing of the vacuum pump. In other words, the arrangement described in the '347 patent can be corrected simply by providing a sufficient margin for the eccentricity adjustments considered to be required for the housing. All of the features described in the '347 patent can be utilized and the disclosure of U.S. Pat. No. 5,366,347 is incorporated by reference herein.

The pump described in more detail in the '347 patent does not, even after the above mentioned corrections, wholly correspond to the requirements which are currently typically applied to pumps in pulp mills, including because the gas to be removed often can contain malodorous or poisonous chemicals. Also a small amount of liquid, a few liters per minute, and in some cases also fibers continually discharge from the vacuum pump. As it would be advantageous from an environmental point of view as well as considering recovery of fibers and chemicals to conduct the exhaust from the vacuum pump to a separate location instead of a "drain", the design of a centrifugal pump and a vacuum pump should consider that the vacuum pump should be capable of discharging the gas, fibers and liquid to a pressured volume, or at least to a location above the pump. The pump must, in other words, besides being capable of generating a vacuum on its suction side, also be capable of producing a head or overpressure on its outlet side.

In the above mentioned patents, the desirability of producing both a vacuum and overpressure has either not been effectively taken into consideration or has not, for other reasons, been dealt with at all. In most of the patents, the control of the pump combination has not been dealt with in any way. In some patents, it has been suggested that a stop valve can be provided on the outlet side of the vacuum pump, by means of which the outlet can be throttled or, if required, even closed. This functions well until the valve actually has to be fully closed. When closed, the valve causes cavitation and pressure shocks in the vacuum pump, greatly increasing the risk that the vacuum pump will be damaged. Another possibility is to change the capacity of the pump, as described in the '347 patent. Controlling the capacity, however, means that the pump no longer has the head required to transport the gas and/or fibers and/or liquid forward. This can be explained by the following example. In the case where only a small amount of gas is separated and only a small vacuum is needed for removing the gas from the centrifugal pump, the vacuum pump is adjusted to generate only a small pressure difference. From this follows that correspondingly only a small pressure difference is available on the outlet side of the pump, which is not enough if, for instance, the exhaust of the pump must flow to a location about twenty meters higher, and sometimes even slightly pressurized.

The above problem has been solved by the method and apparatus according to our invention by providing a control means on the suction side of the vacuum pump, so that the vacuum generated by the vacuum pump in front of the impeller of the centrifugal pump can be controlled totally regardless of the capacity of the vacuum pump. In other words, although only a small vacuum effect is directed towards the centrifugal pump side, the whole capacity of the vacuum pump is available for removal of separated gas, fibers and liquid.

According to one aspect of the present invention a method of operating a centrifugal and vacuum pump combination in which the centrifugal pump has an impeller disposed on the same shaft as a rotor of the vacuum pump, and a gas outlet duct extends between the centrifugal and the vacuum pump, is provided. The method comprises the steps of: (a) operating the pumps so that as the centrifugal pump pumps fluent material, gas is separated from the material, and the vacuum pump draws the gas from the centrifugal pump through the gas outlet duct; and (b) positively controlling the flow of the gas passing through the gas outlet duct between the centrifugal pump and the vacuum pump. The gas outlet duct typically has a given cross-sectional flow area and step (b) may be practiced by changing the effective cross-sectional flow area, e.g. by providing a flexible tubular element in a groove formed adjacent the outlet duct by controlling the flow of fluid to the flexible tubular element to cause it to expand and contract thereby control the cross-sectional area of the gas outlet duct.

The vacuum pump may include a suction opening having a predetermined cross-sectional area and positioned in the gas outlet duct, and step (b) may be practiced by changing the cross-sectional area of the vacuum pump suction opening.

The fluent material pumped by the centrifugal pump is preferably a slurry, e.g. a cellulose fiber slurry having a solids consistency of between about 6–15%. Step (b) may be practiced automatically in response to a conventional consistency sensor sensing the solids consistency of the slurry being pumped by the centrifugal pump. Step (b) may alternatively or also be practiced automatically in response to the sensing (utilizing a conventional pressure sensor) the inlet pressure to the centrifugal pump of the slurry being pumped. Alternatively step (b) may be practiced automatically in response to the gas content of the material being pumped.

The method may also include the further step of discharging gas from the vacuum pump at superatmospheric pressure to a confined volume that is also at superatmospheric pressure. The vacuum pump rotor may be spaced from a housing wall of the vacuum pump, and step (b) may be practiced by changing the spacing between the rotor and the housing wall, as by rotating the vacuum pump housing which preferably is eccentric.

According to another aspect of the present invention a pump is provided comprising the following components: A volute casing and a pump body. A centrifugal pump impeller mounted for rotation by a shaft in the volute casing. A suction opening in the volute casing, and a substantially tangential outlet extending from the volute casing. The impeller including a back plate having a front side facing the suction opening and an opposite back side. At least one working blade connected to the first side of the back plate, and at least one back blade connected to the second side thereof. The pump body including a vacuum pump having a housing and containing a rotor with rotor blades, the rotor mounted on the shaft. The vacuum pump housing including a rear wall and a front wall, the front wall adjacent the volute casing and the rear wall spaced from the front wall and the volute casing, the front wall having a suction opening therein. The vacuum pump housing further comprising an eccentric inner wall surrounding the rotor, an auxiliary air channel, and an outlet leading from the vacuum pump housing to the exterior thereof. A back wall of the volute casing disposed between the impeller back plate and the vacuum pump housing front wall. A gas outlet duct extending through the back wall from the volute casing and the suction opening. And, a control device disposed in the gas outlet duct for controlling the flow of gas through the outlet duct.

Various distinctive features may be provided in the pump as described above. These distinctive features may include the following: The outlet duct is defined by a wall and the control device comprises at least one plate moving in a groove disposed in the outlet duct wall. The at least one plate is movable in either the axial, radial, or peripheral dimension with respect to the shaft. The control device comprises an element disposed in the outlet duct and expandable in the axial, radial, or both axial and radial directions with respect to the shaft, to thereby control the effective cross-sectional area of the outlet duct. The control device element comprises a tube of flexible material and a fluid for expanding or contracting the tube provided therein. The suction opening is disposed in a rotatable element and the control device is operated by rotating the rotatable element. The rotatable member comprises the vacuum pump housing front wall. The control member comprises a ring mounted for movement in the axial direction with respect to the shaft, the ring defining, with the impeller, the gas outlet duct. The ring is movable in the axial direction by expansion or contraction of a fluid filled tubular member and a spring. The gas outlet duct includes an expansion chamber. The auxiliary air duct leads to the expansion chamber. A fluidizing roller is provided which protrudes from the impeller on an opposite side of the impeller from the vacuum pump housing. The vacuum pump outlet leads from the vacuum pump housing rear wall. The gas outlet duct is defined by a spacing between the back wall of the volute casing and the front wall of the vacuum pump housing.

According to another aspect of the present invention the pump, as described above, may have the vacuum pump housing movable into a first position when the inlet pressure to the centrifugal pump is low and a high volume of gas is separated; a second position when the inlet pressure is slightly above atmospheric and a lesser volume of gas is separated; and a third position when the inlet pressure is superatmospheric, the eccentricity of the vacuum pump housing being greater in the third position than in the second position. A throttling valve may be disposed in or adjacent the outlet from the vacuum pump housing.

The invention also relates to a method of controlling a pump as described above by primarily controlling the pressure difference across the vacuum pump by changing the eccentricity of the vacuum pump housing during all operating conditions. The controlling step is practiced by automatically moving the vacuum pump housing between the first, second, and third positions in response to the sensing of the inlet pressure.

It is the primary object of the present invention to provide a simple yet advantageous method of operating a centrifugal and vacuum pump combination, and pump per se. This and other objects of the invention will become clear from an inspection of the detailed description of the invention and from the appended claims.

DETAILED DESCRIPTION OF THE DRAWINGS

Figure 1:
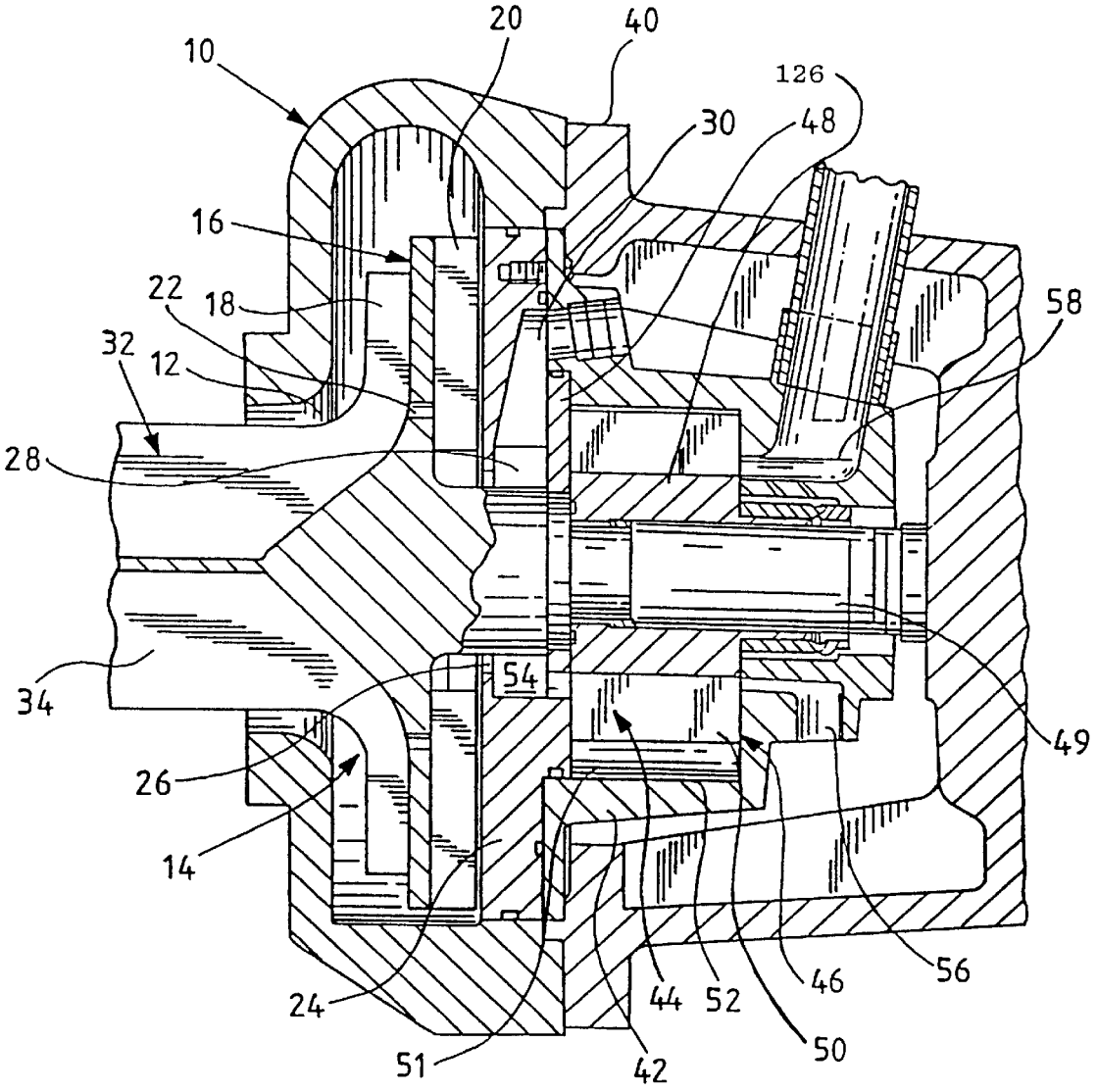
FIG. 1 PRIOR ART
FIG. 1 is an axial cross-sectional view of a prior art centrifugal pump provided with a vacuum pump, in which centrifugal pump the control system according to the invention may be installed.

According to FIG. 1 a centrifugal pump is illustrated having the conventional components of a volute casing 10 and a pump body 40. The volute casing 10 comprises the suction opening 12 of the centrifugal pump and a substantially tangential outlet (not shown). The volute casing 10 surrounds the impeller 14 of the centrifugal pump, the impeller 14 including a back plate 16, working blades 18 attached to the surface on the side of the suction 12 (the "front surface"), and back blades 20 attached to back side of the back plate 16. A plurality of gas outlet openings 22 are provided in the back plate 16 of the impeller 14. A back wall 24 of the pump, preferably detachable, is disposed between the volute casing 10 and the vacuum pump disposed inside the pump body 40; between the back wall 24 and the shaft 49 or, as shown in FIG. 1, a cylindrical projecting part of the impeller 14, a gas outlet duct 26 is formed, in this embodiment enlarging to an annular chamber 28. In the embodiment shown in FIG. 1*a* flushing duct 30, which leads to the chamber 28, is provided in the back wall 24 for cleaning of the gas outlet system of which the duct 26 and chamber 28 are a part. A fluidizing rotor 32, which preferably includes blades 34 extending a distance apart from both the pump shaft 49 and the wall of the suction opening 12, is provided on the impeller of the centrifugal pump where the material to be pumped is a cellulose pulp suspension of medium consistency.

As seen in FIG. 1, a vacuum pump including a housing 42 and a rotor 44 disposed therein is also provided inside the pump body 40. The housing 42 comprises an integral back wall 46, which may be made detachable, if desired. A separate detachable plate 48 or the back wall 24 of the centrifugal pump function as the front wall (facing the centrifugal pump) of the housing 42, though it is also possible to construct the vacuum pump so that its front wall is an integral part of the housing of the vacuum pump and the back wall is detachable. The rotor 44 is attached to the shaft 49, as is the impeller 14 of the centrifugal pump, and provided with blades 50, which, however, do not extend to the inner wall 52 of the housing 44. The blades 50 effect rotation of a liquid ring 51 when the vacuum pump is in operation.

The inner wall 52 of the housing 42, which surrounds the rotor 44, is eccentric so that the liquid ring 51 rotated by the blades 50 in the housing 42 causes changes of the volume of the spaces between the blades 50 depending on the mutual positions of the blades 50 and the inner wall 52 of the housing 42. The front wall 48 of the housing 42 is provided with a suction opening 54 for the vacuum pump which forms a part of the gas outlet duct 26 between the centrifugal pump and the vacuum pump. The suction opening 54 is crescentic and positioned in relation to the housing 42 so that, at the suction opening 54, the volume of the spacings between the blades 50 of the rotor 44 are increasing. This results in a vacuum being generated between the blades 50 of the rotor 44, so that the vacuum pump sucks gas into the spaces between the blades 50.

In a corresponding part of the back wall 46 of the vacuum pump in the embodiment of FIG. 1, there also preferably is an auxiliary air duct 56, through which the vacuum pump sucks gas in a similar manner into the spaces between the blades 50, if enough gas is not received from the centrifugal pump. A conventional valve (not shown) which opens at a given pressure difference is usually connected to the auxiliary air duct 56. The auxiliary air duct 56 can also be led through the back wall 24 of the centrifugal pump or through the front wall 48 of the vacuum pump to the chamber 28. An outlet duct 58 of the vacuum pump is also provided in the back wall 46 of the vacuum pump, through which primarily gas, but also small amounts of liquid, and possibly also solid matter (e.g. fibers), is discharged. The outlet duct 58 leads to the vacuum pump at a point which is spaced about 180° from the suction opening 54, preferably in the back wall 46 of the vacuum pump. Alternatively duct 58 can also be positioned in the front wall 48 of the vacuum pump or the back wall 24 of the centrifugal pump separating the pumps, e.g. so that duct 58 is located directly on the opposite side of the shaft 49 in relation to the suction opening 54.

Examples of various other possible pump constructions are shown in detail in the U.S. Pat. Nos. 4,981,413, 5,078,573, 5,114,310, 5,116,198, 5,151,010, and 5,152,663 the disclosures of which are incorporated by reference herein. The constructions shown in the above mentioned patents are only examples of advantageous and useful arrangements, but do not show all possible constructions which may be utilized according to the invention.

Figure 2:
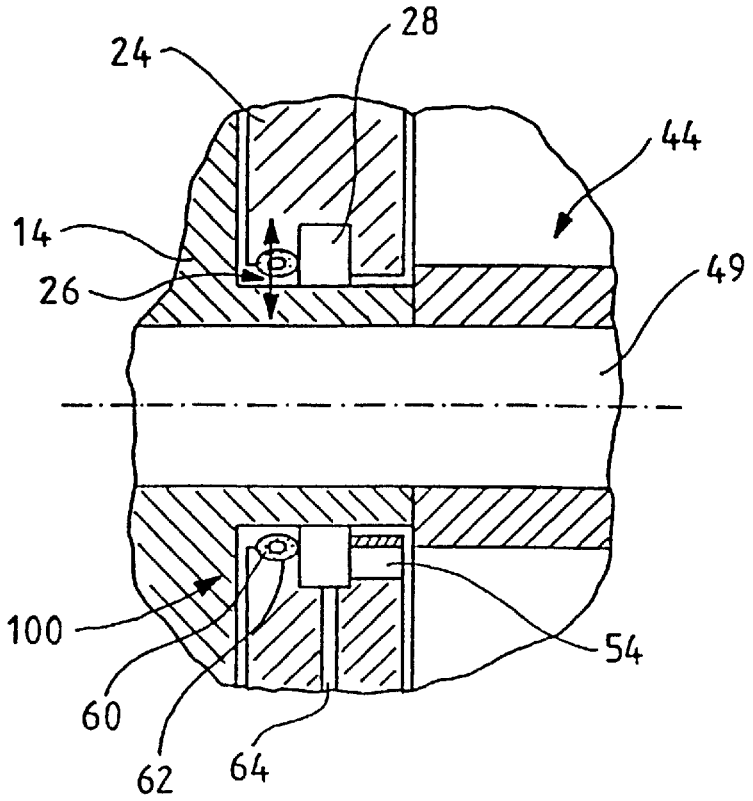
FIG. 2 is a detailed cross-sectional view of a first embodiment of the centrifugal pump of FIG. 1 with the control system according to the invention therein.

FIG. 2 shows a partial, detailed sectional view of a centrifugal pump according to a preferred embodiment of the invention. In FIG. 2 (and subsequent FIGURES) structures that are the same as those in FIG. 1 are shown by the same reference numeral.

FIG. 2 shows the shaft 49 of the pump, the impeller 14 with its cylindrical projecting part, the rotor 44 of the vacuum pump, the back wall 24 of the centrifugal pump with its chamber 28, and the suction opening 54 in the back wall between the chamber 28 and the vacuum pump. A device 100—according to the present invention—for controlling the suction flow of the vacuum pump according to the invention, comprises an annular tube 60 made of rubber or a like resilient material which can be expanded mechanically, hydraulically, pneumatically or in a like manner. The tube 60 is disposed in a groove 62 in the innermost edge in the radial direction of the back wall 24 of the centrifugal pump, preferably on the centrifugal pump side of the chamber 28. A pressure medium (e.g. a gas or liquid) is fed to the annular tube 60, for instance through a duct (not shown) disposed in the back wall 24. When the control device 100 is positioned as shown in FIG. 2, it is possible to lead the auxiliary air duct 64 through the back wall 24 of the chamber 28. The device 100 functions so that, if the cross sectional flow area from the centrifugal pump to the vacuum pump is throttled, the pressure of the pressure medium is increased, so that the annular tube 60 expands and comes closer to the cylindrical projecting part of the impeller 14. When the pressure in the tube 60 is released, the cross-sectional flow area is almost completely open and there is no obstruction to the flow from the centrifugal pump to the vacuum pump. A corresponding second expansion tube (like tube 60) or the like can also be disposed in the annular chamber 28, so that the second tube (not shown), when expanding, throttles not only the cross-sectional flow area but also directly the suction opening 54 of the vacuum pump.

Figure 3:
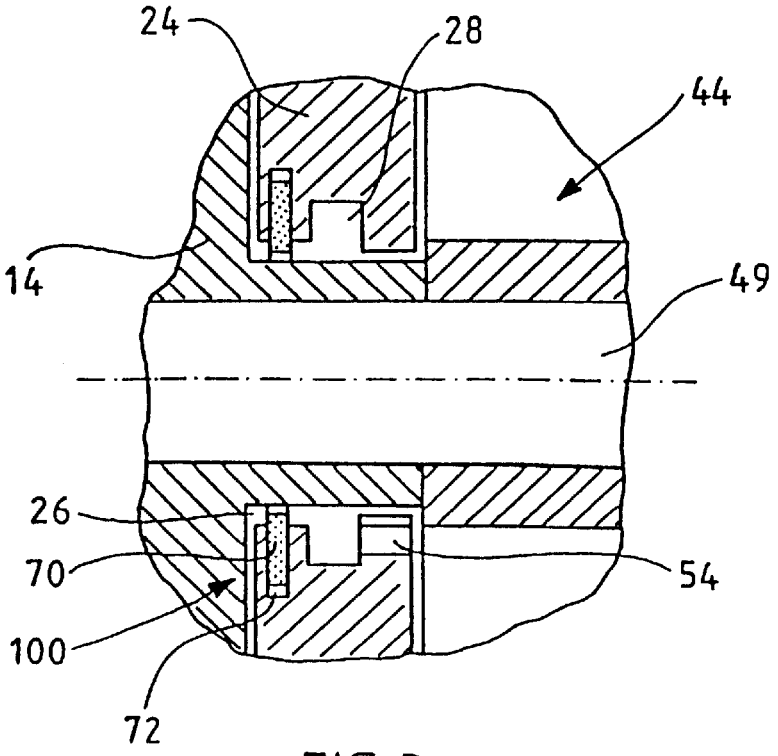
FIG. 3 is a view like that of FIG. 2 of a second embodiment of the control system according to the invention.

FIG. 3 shows the shaft 49 of the pump, the impeller 14 with its cylindrical projecting part, the rotor 44 of the vacuum pump and the back wall 24 of the centrifugal pump with its chamber 28, and the suction opening 54 in the back wall between the chamber 28 and the vacuum pump. The control device 100 according to the invention in this embodiment consists of or comprises a preferably radial, annular groove 72 provided in the back wall 24, and at least one or preferably several closing flaps 70 disposed slidingly therein. There can be, for instance, one closing flap 70, so that the gas outlet duct 26 between the centrifugal pump and the vacuum pump can be throttled only to an extent of 180° measured in the peripheral direction. Even such a possibility must be taken into consideration, as one of the above mentioned U.S. patents mentions a nonannular opening in the back wall 24, i.e. a flow duct which according to one embodiment consists of only a half annulus.

When there are two closing flaps 70, they are preferably disposed on opposite sides of the shaft 49 and in a manner such that they overlap one another in the groove 72. The inner edge(s) of the flap(s) 70 is (are) preferably of the same curved shape as the periphery of the shaft 49 or, as seen in FIG. 3, or that of the cylindrical projecting part of the impeller 14. If there are several flaps 70, they are preferably positioned to overlap according to the principle described above for two flaps 70, or they are positioned to open and close in the same way as a shutter of a camera.

When a closing flap 70 is disposed between the chamber 28 and the centrifugal pump, it is possible to lead supplementary air into the chamber 28 in the manner shown in FIG. 2. In the FIG. 3 embodiment throttling of the cross-sectional flow area can also be accomplished by providing corresponding (to flaps 70) closing flaps (not shown) in a groove formed in the bottom of chamber 28.

The flaps 70 can be moved hydraulically, pneumatically, by rods extending from the outside of the pump to the flaps 70, or the like. The flaps 70 can thus move linearly in the radial direction, or turn around a joint against the shaft 49. It is further possible to arrange the bottom of said radial groove 72 to ascend against the shaft 49, so that the flaps 70 can be moved against the shaft/projecting part of the impeller 14 by sliding the flaps 70 in a peripheral direction along the bottom of the groove 72. It is to be noted that both in this embodiment and the following ones, the supplementary air duct is not described, as the position and operation thereof has been described above. In all embodiments a supplementary air duct 64, as seen in FIG. 2, may be provided if so desired.

Figure 4:
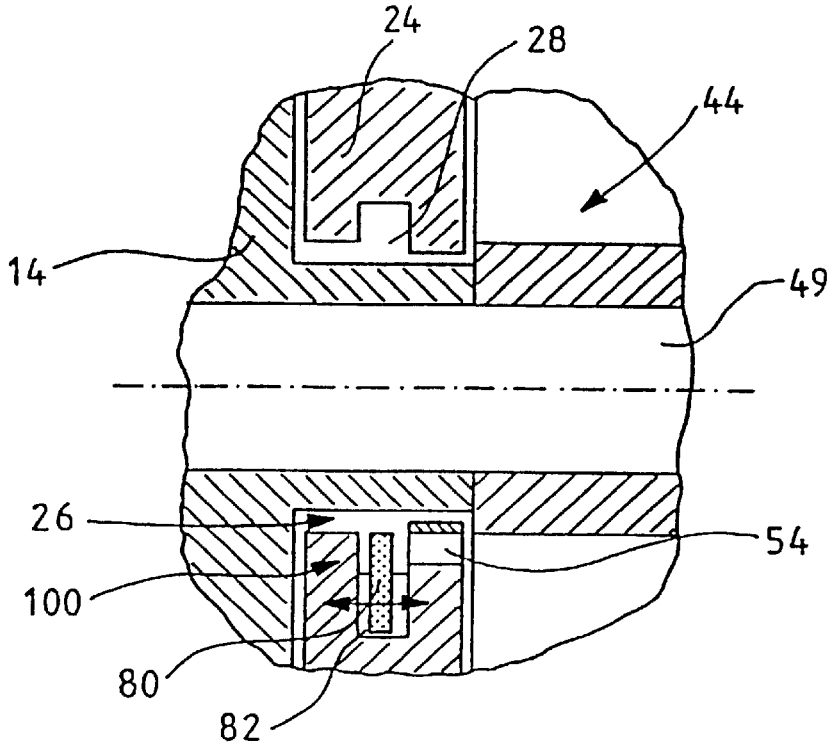
FIG. 4 is a view like that of FIG. 2 of a third embodiment of the control system according to the invention.

FIG. 4 shows the shaft 49 of the pump, the impeller 14 with its cylindrical projecting part, the rotor 44 of the vacuum pump and the back wall 24 of the centrifugal pump with its chamber 28, and the suction opening 54 in the back wall between the chamber 28 and the vacuum pump. The control device 100 according to the FIG. 4 embodiment comprises or consists of a closing plate 80, which is peripherally at least of the same size as the suction opening 54 of the vacuum pump. When the closing plate 80 is moved against the suction opening 54, the cross sectional flow area from the chamber 28 to the vacuum pump decreases. The closing plate 80 can be operated mechanically, hydraulically or pneumatically. One way is to provide a space in the back wall 24 on both sides of the closing plate 80 for a member which by means of a pressure medium changes its size, or for small pressure medium cylinders, for example, by means of which the closing plate 80 can be moved axially. Another possibility is to provide a spring return for the closing plate in such a way that, for example, the plate 80 is moved by or against the spring bias towards the suction opening 54.

Figure 5:
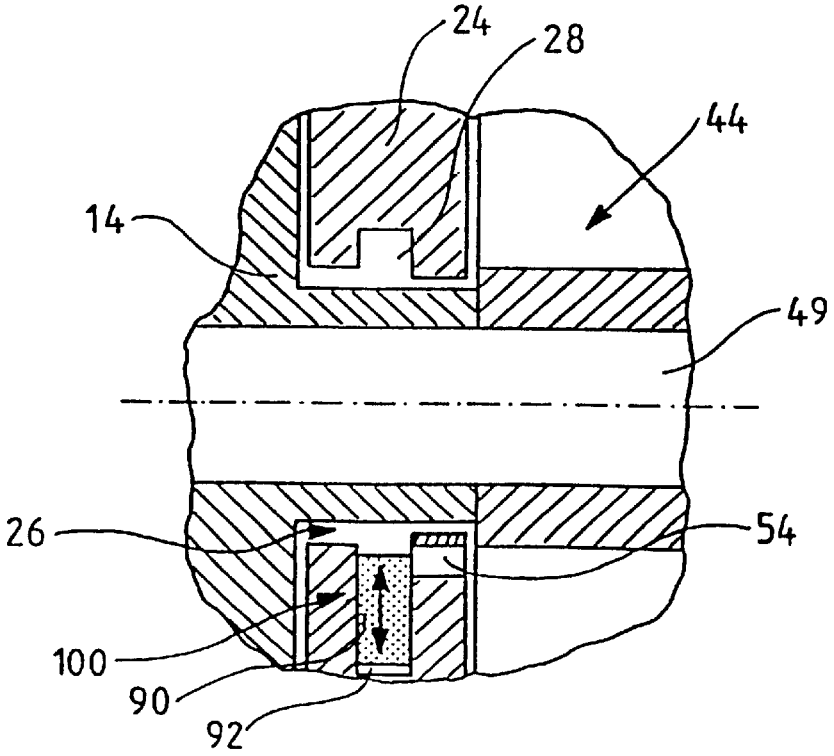
FIG. 5 is a is a view like that of FIG. 2 of a fourth embodiment of the control system according to the invention.

FIG. 5 shows the shaft 49 of the pump, the impeller 14 with its cylindrical projecting part, the rotor 44 of the vacuum pump and the back wall 24 of the centrifugal pump with its chamber 28, and the suction opening 54 in the back wall between the chamber 28 and the vacuum pump. The control device 100 according to the FIG. 5 embodiment comprises or consists of a groove 92 formed in the bottom of chamber 28 and a radially sliding closing plate 90 disposed therein. The closing plate 90 and the groove 92 are dimensioned peripherally so that they are at least substantially of the same size as the suction opening 54 of the vacuum pump. When the closing plate 90 is moved radially (by conventional mechanical, hydraulic, or pneumatic means), the suction opening 54 of the vacuum pump either closes or opens depending on the direction of movement of the closing plate 90. The plate 90 can be positioned to be operated in the same way as the flap 70 in the embodiment according to FIG. 3. It is also possible, instead of throttling the suction opening 54 by radially moving the plate 90 in the bottom of chamber 28, to move the plate in the peripheral direction to effect throttling.

Figure 6A:
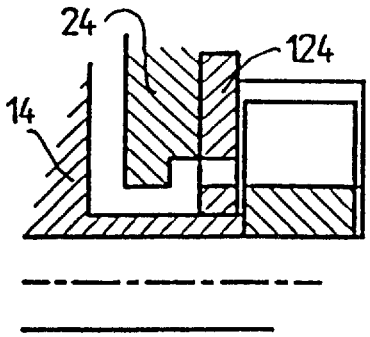
FIG. 6*a* is a view like that of FIG. 2 of a fifth embodiment of the control system according to the invention.
Figure 6B:
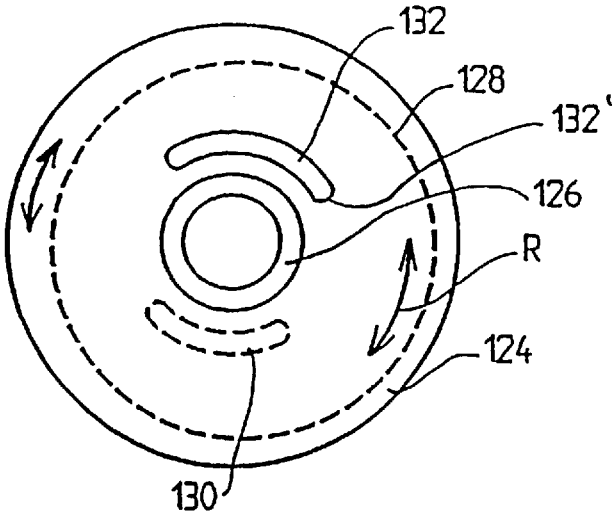
FIG. 6*b* is an end view of the system of FIG. 6*a;*

FIG. 6*b* illustrates a partial end view of a centrifugal pump according to a fifth preferred embodiment of the invention. The arrangement is viewed in the axial direction from the side of the centrifugal pump of the partial cross-section of FIG. 6*a* in such a way that the impeller 14 of the centrifugal pump and the back wall 24 of the centrifugal pump have been removed with the exception of the suction plate 124 disposed concentrically in the back wall. The axis defining component 126 of the rotor 44 of the vacuum pump can be seen as the innermost element in FIG. 6*b,* and is also visible in FIG. 1. The circle around it illustrates a hole in the suction plate 124 for a shaft or a cylindrical projecting part of the impeller 14. The eccentric circle 128 indicated by a broken line illustrates the eccentric housing 42 of the vacuum pump. The oblong curved opening 130 indicated by a broken line illustrates the outlet opening for the gas to be removed from the vacuum pump, located in the back wall 46 of the housing 42 of the vacuum pump. In the position illustrated by FIG. 6*b* the outlet opening is in the converging side of the eccentric housing 128 of the vacuum pump, i.e. on the pressure side, so that the volume between the liquid ring 51 and the element 126 of the rotor 44 converges in such a way that the gas in that volume will be pressed out of the pump through the opening 130. The oblong curved opening 132 is the suction opening of the vacuum pump.

As illustrated by FIG. 6*b,* the opening 132 is positioned in such a way that the volume between the liquid ring 51 rotating in the housing 42 and the element 126 of the rotor expands, in other words the pump sucks gas from the opening 132 to fill the volume. The front edge of the opening 132' is positioned substantially at the greatest eccentricity of the housing 42. The curved arrow R illustrates the rotating direction of the rotor of the vacuum pump. It is characteristic of this embodiment of the invention that the flow of gas from the centrifugal pump to the vacuum pump is controlled by turning the suction plate 124 from the position illustrated in FIG. 6*b* clockwise, for example, so that the front edge 132' of the suction opening 132 moves past the maximal eccentricity of the housing 42 of the vacuum pump to the side where the pump begins to generate pressure. The gas between the liquid ring 51 and the element 126 of the rotor 44 is pressed back to the suction side through the suction opening 132, i.e. towards the centrifugal pump. This results in at least the suction capacity of the vacuum pump being weakened, and, if the suction plate 124 is turned enough, in the suction being totally stopped. The turning of the suction plate 124 is easily effected for example by means of a shaft 49 led to the separating surface of the back wall 24 and the suction plate 124 through the body of the centrifugal pump. The end of the shaft 49 is thus preferably provided with a thread and the edge of the suction plate 124 with teeth, so that when the shaft 49 is turned, the suction plate 124 also turns. The turning of the shaft 49 may be effected, e.g. either manually or electrically by means of a motor, so that the system may, if needed, be provided with various control devices.

Figure 7:
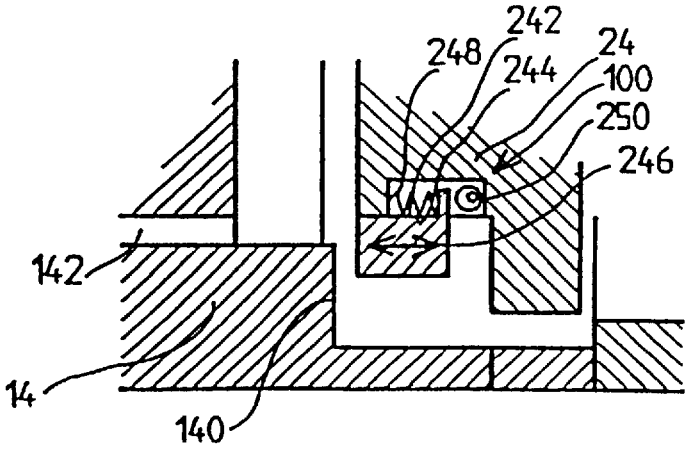
FIG. 7 is a is a view like that of FIG. 2 of a sixth embodiment of the control system according to the invention.

FIG. 7 illustrates a sixth preferred embodiment of the invention. In FIG. 7 the impeller 14 of the centrifugal pump, or rather the cylindrical projecting part thereof, is provided with a shoulder 140 and the back wall 24 is provided with a guide surface 242, along which the preferably annular control member 244 may be moved either towards the shoulder 140 or away from it. The suction towards the flow coming from the gas outlet opening(s) 142 of the impeller 14 may be adjusted to the extent desired. Movement of the control device 142 may be controlled by providing a few levers 246 in the periphery of the annular control device within even distances from each other. For each lever 246, a cavity is disposed in the back wall 24, in which cavities for example a spring member 248 is positioned on one side of the levers 246 and for example a fluid filled tubular member 250 which can be expanded by means of pressure is positioned on the other side. A pressure member 250 may be replaced by, for example, rotatable eccentric levers, or like mechanical components.

Figure 8A:
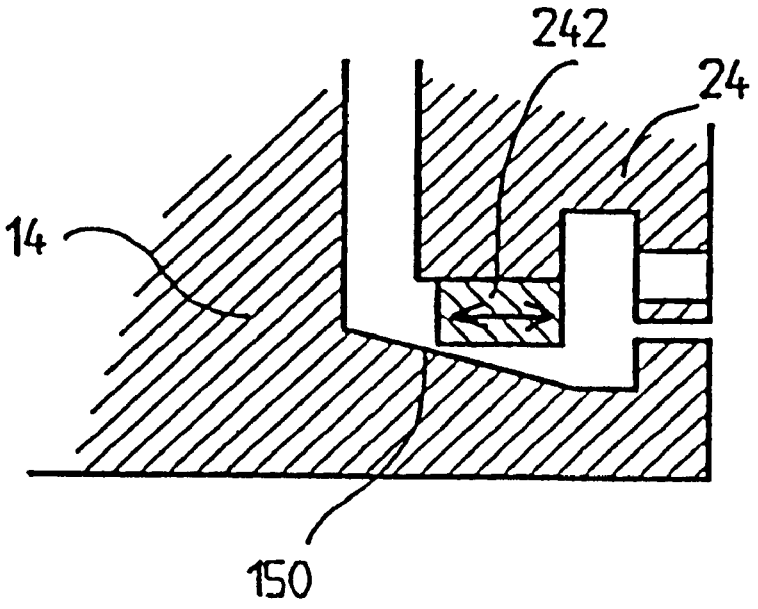
FIGS. 8*a* and 8*b* are views like that of FIG. 2 which illustrate seventh and eighth embodiments of the control system according to the invention.
Figure 8B:
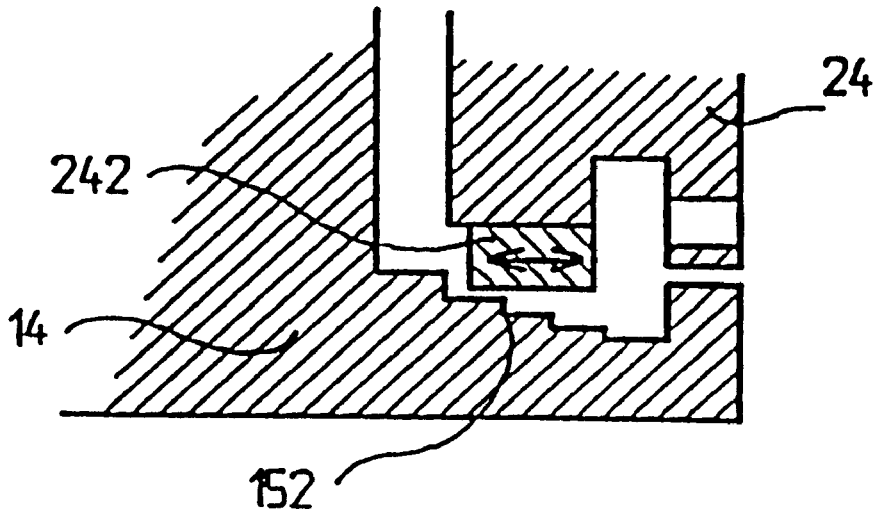

FIGS. 8*a* and 8*b* illustrate arrangements according to a seventh and eighth preferred embodiment of the invention. The arrangements in FIGS. 8*a* and 8*b* are based on the movable control member 242 already described in the preceding embodiment. In these embodiments, the surface limiting, the cross sectional flow area together with the control member 242 is formed by a conical surface 150 (FIG. 8*a*) or a stepwise converging surface 152 of the cylindrical projecting part of the impeller 14. Movement of the control member 242 may be effected in substantially in the same manner as described in the preceding figures.

Another control system which could be used according too the invention is a device in which teeth extending substantially to the shaft/cylindrical projecting part of the impeller 14 are formed in the inner edge of the back wall 24 of the centrifugal pump so that they preferably cover at least half, of the periphery. A turnable plate is used as counterpart, the teeth of which are preferably of the same size as those of the back wall, so that the remaining cross-sectional flow area can be opened by turning the teeth so that they are in the flow direction on top of each other, or may be opened by positioning the teeth to engage each other.

Further, yet another potential control system can be provided by changing the clearances of the rotor of the vacuum pump, which means in practice that at least one end of the housing of the vacuum pump is moved relative to the rotor, or that at least one end and the rotor are both moved. When the spacing between the rotor, especially the blades of the rotor, and the housing is increased, the gas flow around the edges of the blades increases rapidly, so that the suction generated by the pump decreases substantially. In practice, the most probable one of the control manners of the spacings described above is likely to be providing the front wall of the vacuum pump so that it is movable.

The function of the control device, or in other words the flow, is controlled either manually or preferably automatically as a function of the consistency (as sensed by a conventional consistency sensor) of the material to be pumped, as a function of the inlet pressure (as sensed by a conventional pressure sensor) of the material to be pumped, as a function of both the consistency of the material to be pumped and the inlet pressure, or as a function of the gas content (again, as sensed by a conventional sensor) of the material to be pumped. The control according to the inlet pressure can be accomplished for instance so that the control member is moved in a direction which throttles the cross-sectional flow area of the gas outlet duct when the inlet pressure increases. The flaps can be moved for instance by means of a pressure medium cylinder provided in the back wall of the centrifugal pump, which cylinder pushes the flap towards the shaft against a spring force, or by using a cylinder, for instance a two-way cylinder, positioned outside the pump body.

It will thus be seen from the foregoing that a number of different solutions have been developed by means of which the centrifugal pump and vacuum pump combination according to the invention can be made to function optimally in all possible operating conditions. It is for instance possible to discharge in a controlled manner a small amount of superatmospheric pressure gas and liquid and possible solid matter flowing along with it by means of the vacuum pump for instance to a pressurized cistern placed 30 meters above the pump. The invention is not limited to the embodiments described and illustrated above, which are presented merely to provide an illustration of the many solutions by means of which control can be accomplished. It is to be understood that also other technical solutions are possible within the scope and spirit of the invention, which scope is to be accorded the broadest interpretation of the appended claims so as to encompass all equivalent structures and methods.

What is claimed is:

1. A method of operating a centrifugal and vacuum pump combination in which the centrifugal pump has a suction side and an impeller disposed on the same shaft as a rotor of the vacuum pump, and a gas outlet duct extends between the centrifugal pump and the vacuum pump, the method comprising the steps of:

(a) operating the pumps so that as the centrifugal pump pumps fluent material, gas is separated from the material, and the vacuum pump draws the gas from the centrifugal pump through the gas outlet duct; and (b) positively controlling the vacuum pump so as to create a counter-pressure which increases in response to an overpressue on the suction side of the centrifugal pump in order to positively prevent fluent material from entering the vacuum pump.

2. A method as recited in claim 1 wherein step (a) is practiced to pump a cellulose fiber slurry having a solids consistency of between about 6–15%.

3. A method as recited in claim 1 wherein step (b) is practiced automatically in response to the inlet pressure to the centrifugal pump of the material being pumped.

4. A method as recited in claim 3 wherein step (a) is practiced to pump a cellulose fiber slurry having a solids consistency of between about 6–15%.

5. A method as recited in claim 1 wherein the fluent material being pumped has gas therein; and wherein step (b) is practiced automatically in response to the gas content of the material being pumped.

6. A method as recited in claim 5 wherein step (a) is practiced to pump a cellulose fiber slurry having a solids consistency of between about 6–15%.

7. A method as recited in claim 1 comprising the further step of discharging gas from the vacuum pump at superatmospheric pressure into a confined volume that is at superatmospheric pressure.

8. A method as recited in claim 7 wherein step (a) is practiced to pump a cellulose fiber slurry having a solids consistency of between about 6–15%.

9. A method as recited in claim 1 wherein the vacuum pump rotor is spaced from a housing wall of the vacuum pump; and wherein step (b) is practiced by changing the spacing between the rotor and the housing wall.

10. A method as recited in claim 9 wherein step (a) is practiced to pump a cellulose fiber slurry having a solids consistency of between about 6–15%.

11. A method as recited in claim 1 wherein the fluent material pumped by the centrifugal pump is a slurry; and wherein step (b) is practiced automatically in response to the inlet pressure to the centrifugal pump of the slurry being pumped.

12. A method as recited in claim 11 wherein step (a) is practiced to pump a cellulose fiber slurry having a solids consistency of between about 6–15%.

13. A pump comprising:

a volute casing and a pump body;

a centrifugal pump impeller mounted for rotation by a shaft in said volute casing;

a suction opening in said volute casing, and a substantially tangential outlet extending from said volute casing;

said impeller including a back plate having a front side facing said suction opening and an opposite back side;

at least one working blade connected to said first side of said back plate, and at least one back blade connected to said second side thereof;

said pump body including a vacuum pump having a housing and containing a rotor with rotor blades, said rotor mounted on said shaft;

said vacuum pump housing including a rear wall and a front wall, said front wall adjacent said volute casing and said rear wall spaced from said front wall and said volute casing, said front wall having a suction opening therein;

said vacuum pump housing further comprising an eccentric inner wall surrounding said rotor, an auxiliary air channel, and an outlet leading from said vacuum pump housing to the exterior thereof;

a back wall of said volute casing disposed between said impeller back plate and said vacuum pump housing front wall;

a gas outlet duct extending through said back wall from said volute casing and including said suction opening of said vacuum pump housing front wall; and said vacuum pump housing being movable into a first position when the inlet pressure to said centrifugal pump is low and a high volume of gas is separated; a second position when the inlet pressure is slightly above atmospheric and a lesser volume of gas is separated and creates a low counter-pressure; and a third position when the inlet pressure is superatmospheric, the eccentricity of said vacuum pump housing being greater in said third position than in said second position and creates a higher counter-pressure than in said second position in order to positively prevent the fluent material from flowing into the vacuum pump.

14. A pump as recited in claim 13 further comprising a throttling valve in or adjacent said outlet from said vacuum pump housing.

15. A method of operating a pump as recited in claim 13 comprising the step of primarily controlling the pressure difference across the vacuum pump by changing the eccentricity of the vacuum pump housing during all operating conditions.

16. A method as recited in claim 15 wherein the pump pumps a cellulose slurry having a solid consistency of between about 6–15%.

17. A method as recited in claim 15 wherein said controlling step is practiced by automatically moving the vacuum pump housing between said first, second, and third positions in response to the sensing of the inlet pressure.

18. A method as recited in claim 17 wherein the pump pumps a cellulose slurry having a solid consistency of between about 6–15%.

* * * * *